US006240687B1

(12) United States Patent
Chong

(10) Patent No.: US 6,240,687 B1
(45) Date of Patent: Jun. 5, 2001

(54) FRAME CONSTRUCTION FOR MODULAR OFFICE FURNITURE

(75) Inventor: Jonathan Chee Yeen Chong, Chicago, IL (US)

(73) Assignee: The Marvel Group, Inc., Chicago, IL (US)

( * ) Notice: Subject to any disclaimer, the term of this patent is extended or adjusted under 35 U.S.C. 154(b) by 0 days.

(21) Appl. No.: 09/302,314

(22) Filed: Apr. 29, 1999

Related U.S. Application Data

(60) Provisional application No. 60/109,650, filed on Nov. 24, 1998.

(51) Int. Cl.[7] ..... E04H 1/00

(52) U.S. Cl. ..... 52/238.1; 52/633; 52/650.3; 52/651.1; 287/189.36; 220/84; 312/265.3; 312/265.2; 312/265.4

(58) Field of Search ..... 52/238.1, 633, 52/650.3, 651.1; 287/189.36; 220/84; 312/265.3, 265.2, 265.4

(56) References Cited

U.S. PATENT DOCUMENTS

| | | | |
|---|---|---|---|
| 2,127,280 | | 8/1938 | Zimbalist . |
| 2,534,952 | | 12/1950 | Comer . |
| 2,956,688 | | 10/1960 | Galassi . |
| 3,353,684 | | 11/1967 | Chesley . |
| 3,601,432 | | 8/1971 | Fenwick . |
| 3,666,303 | | 5/1972 | Huls . |
| 3,669,479 | * | 6/1972 | Payne ..... 287/189.36 |
| 3,730,108 | | 5/1973 | Stroh . |
| 3,794,281 | | 2/1974 | Munsey . |
| 3,966,158 | | 6/1976 | Boundy . |
| 4,133,433 | | 1/1979 | Wolf . |
| 4,171,789 | | 10/1979 | Vander Hoek et al. . |
| 4,198,913 | | 4/1980 | Haworth et al. . |
| 4,387,872 | | 6/1983 | Hogue . |
| 4,971,281 | | 11/1990 | Steinbeck . |
| 5,116,007 | | 5/1992 | Von Gunton et al. . |
| 5,433,327 | | 7/1995 | Benvenuti et al. . |
| 5,494,246 | | 2/1996 | McCarthy et al. . |
| 5,538,213 | | 7/1996 | Brown . |

* cited by examiner

*Primary Examiner*—Carl D. Friedman
*Assistant Examiner*—Christy M. Syres
(74) *Attorney, Agent, or Firm*—Edgar A. Zarins; Lloyd D. Doigan

(57) ABSTRACT

A modular office system incorporating a frame construction with improved stability to support components of the office system. The frame construction generally includes upright supports and crossbeams. The uprights and crossbeams have a tubular configuration to allow the passing of utility wiring. The crossbeams include triangular gussets to improve the support connection between the uprights and crossbeams.

7 Claims, 5 Drawing Sheets

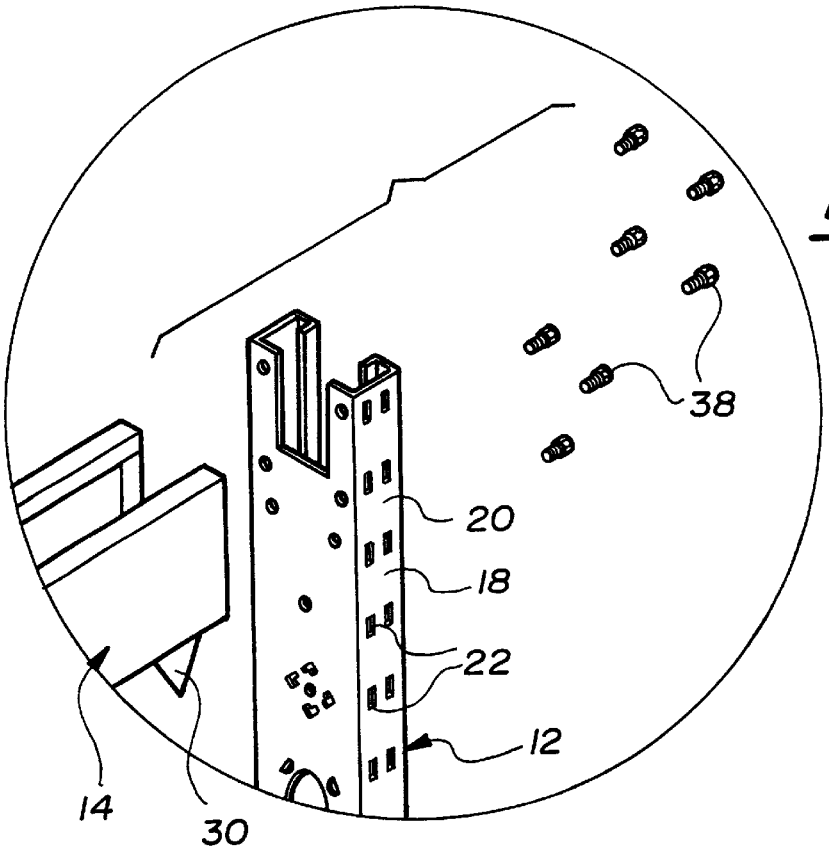
Fig-5
Fig-6
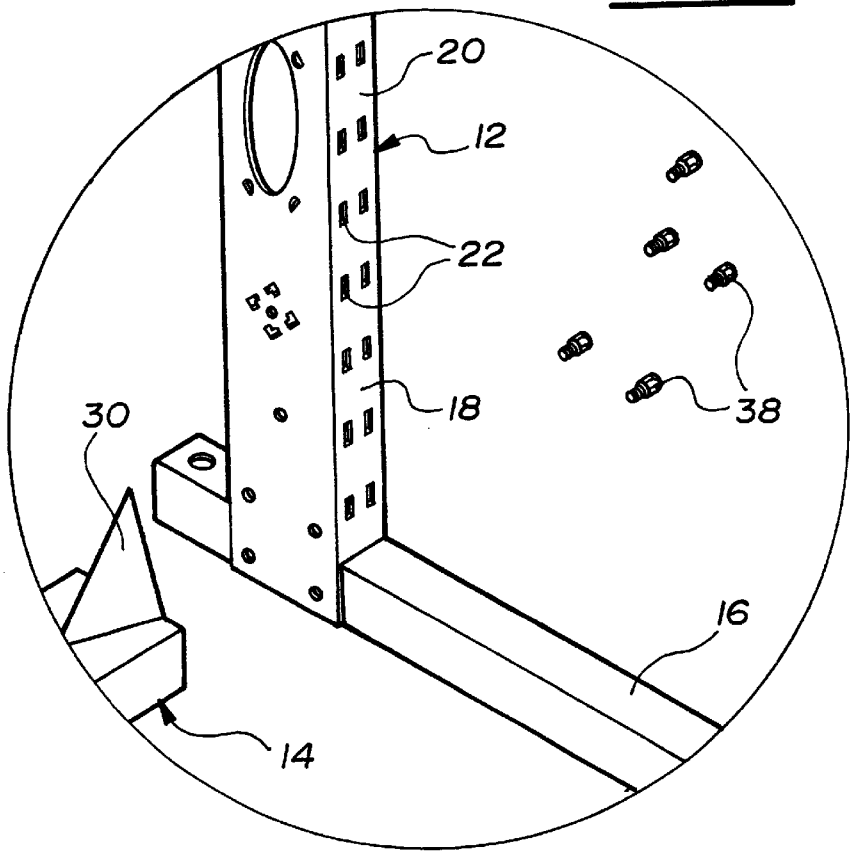

FRAME CONSTRUCTION FOR MODULAR OFFICE FURNITURE

This application claims the priority of U.S. Provisional Patent Application No. 60/109,650 filed on Nov. 24, 1998.

BACKGROUND OF THE INVENTION

I. Field of the Invention

This invention relates to modular office furniture and, in particular, to a frame construction for modular office systems which incorporates upright frame members and crossbeams connecting the uprights for stable mounting of panels and desktops.

II. Description of the Prior Art

Modular office systems have become increasingly popular for their ease of installation and relatively low cost in association with the flexibility such systems provide. Office cubicles, desks and partitions can be easily rearranged or disassembled as personnel requirements change. However, these office systems must also be stable enough to withstand continuous use while also being capable of delivering essential utilities such as electrical power, telephones and computer networking. Because of the modular construction of such office systems, supplying such utilities must be conveniently accomplished. It is also desirable to organize the utility wiring throughout the modular system to facilitate repair or replacement.

Prior known office systems are very rigid in their construction variations. Typically, a frame is provided to which appropriate panels, drawers and desktops are mounted. Wiring may be run through the frame or between panels. However, such prior known systems do not provide an opportunity to alter the system configuration using the same components.

SUMMARY OF THE PRESENT INVENTION

The present invention overcomes the disadvantages of the prior known modular office systems by providing a frame construction having upright supports for supporting panels and desktops and detachable cross beams extending between the uprights to stabilize the frame.

The frame construction of the office system of the present invention includes upright supports for attaching components such as shelves, desktops and panels and crossbeams connected between upright supports to provide strength and stability. The uprights have a substantially tubular configuration to facilitate the feeding of wiring and include slots to mount cluster shelf panels and shelf brackets. The uprights include laterally extending support legs. The crossbeams are secured to the uprights at predetermined positions using fasteners. The crossbeams also have a tubular construction and include substantially triangular gussets which engage the uprights to improve the stability of the frame. In a preferred embodiment, the gussets are formed as a separate component and inserted into slots formed in the crossbeam. An end plate holds the gusset in position.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which:

FIG. 5 is an enlarged view of a portion of the frame construction;

FIG. 6 is an enlarged view of a portion of the frame construction;

DETAILED DESCRIPTION OF A PREFERRED EMBODIMENT OF THE PRESENT INVENTION

Figure 1:
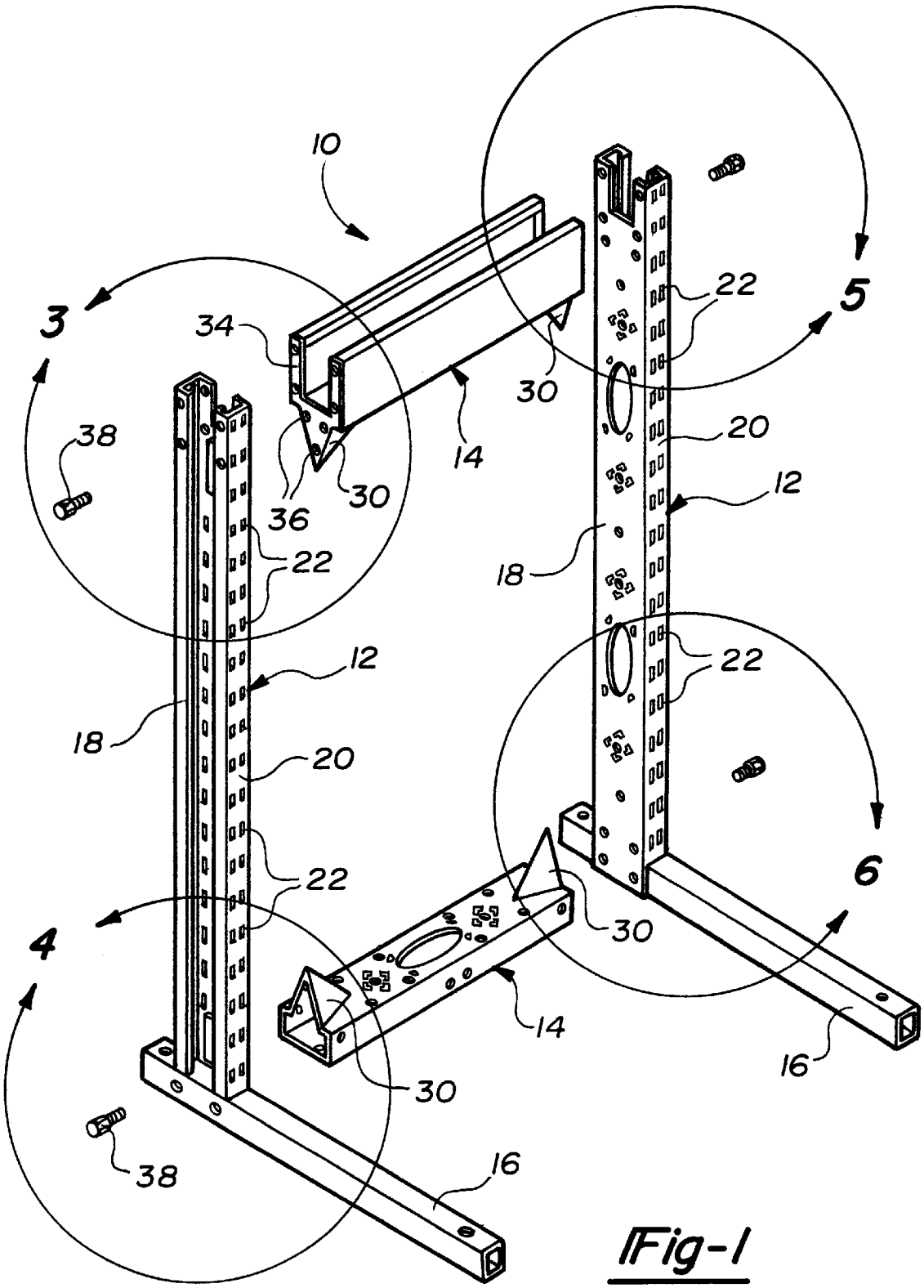
FIG. 1 is an exploded view of the frame construction for office furniture embodying the present invention.
Figure 2:
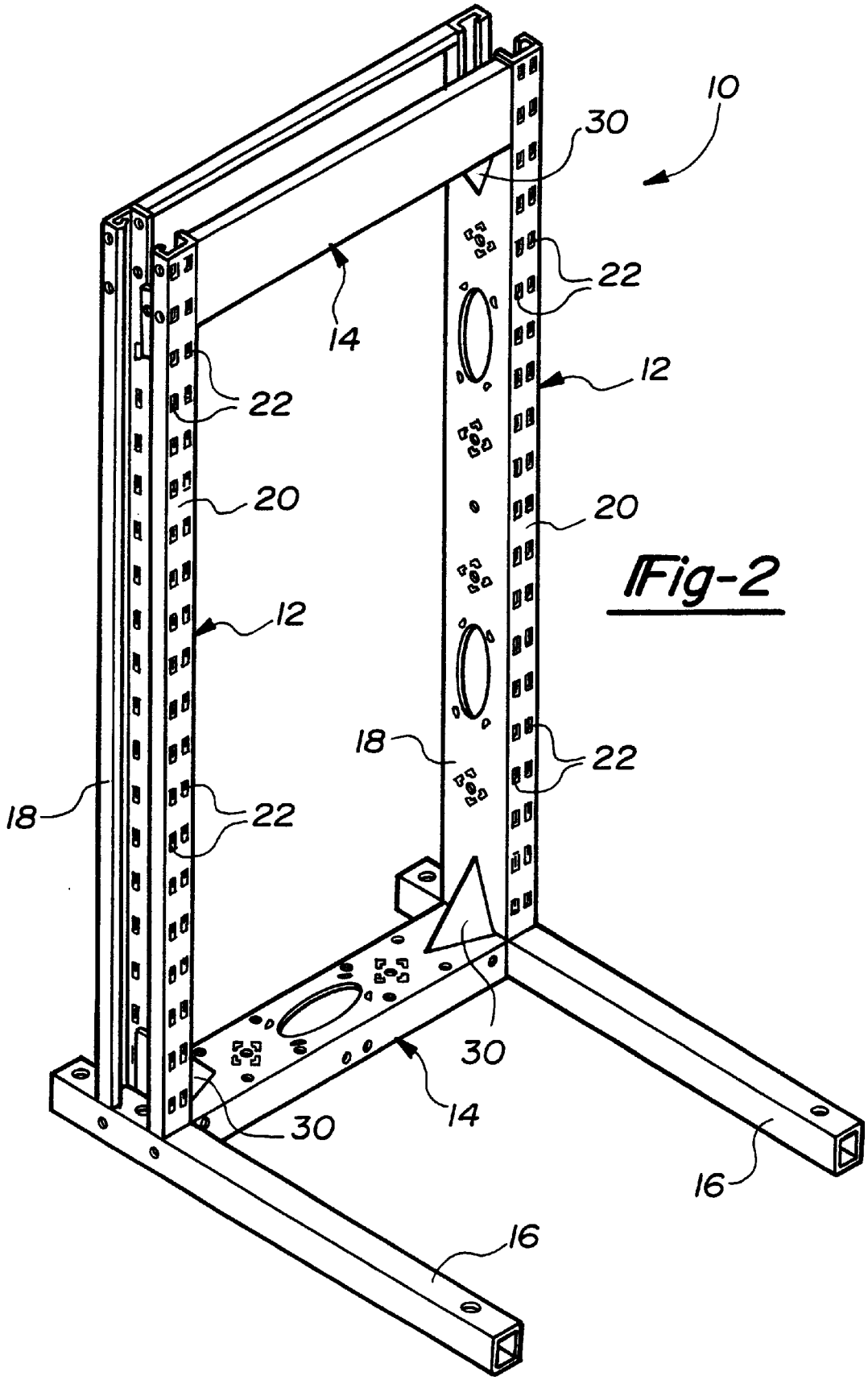
FIG. 2 is a perspective view of the assembled frame construction.
Figure 3:
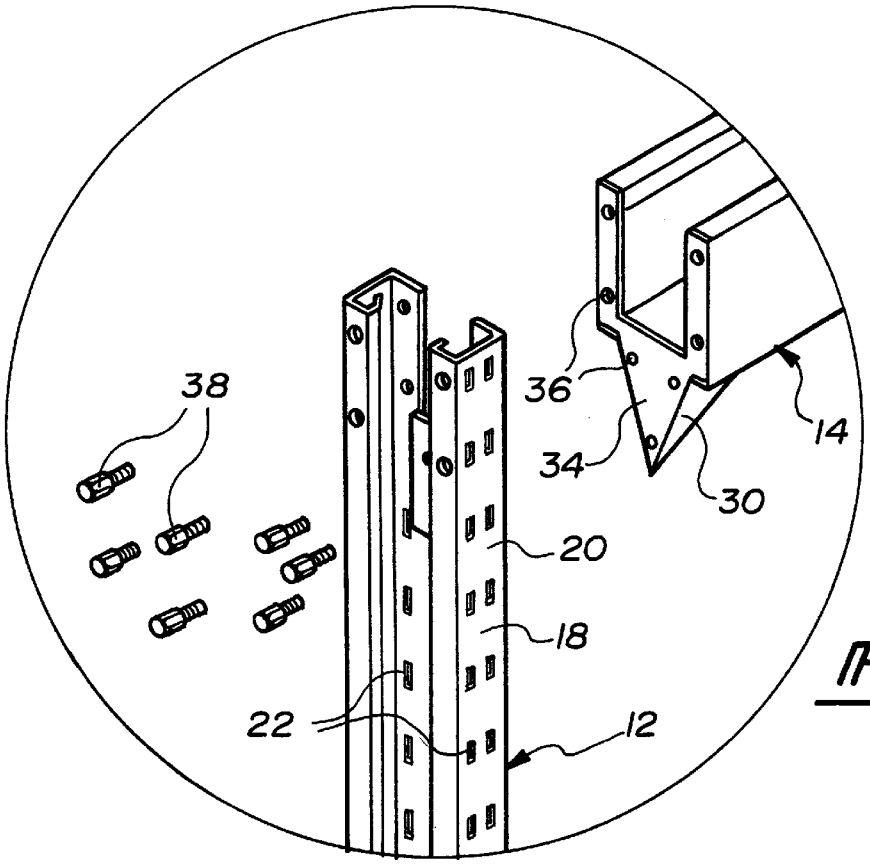
FIG. 3 is an enlarged view of a portion of the frame construction.
Figure 4:
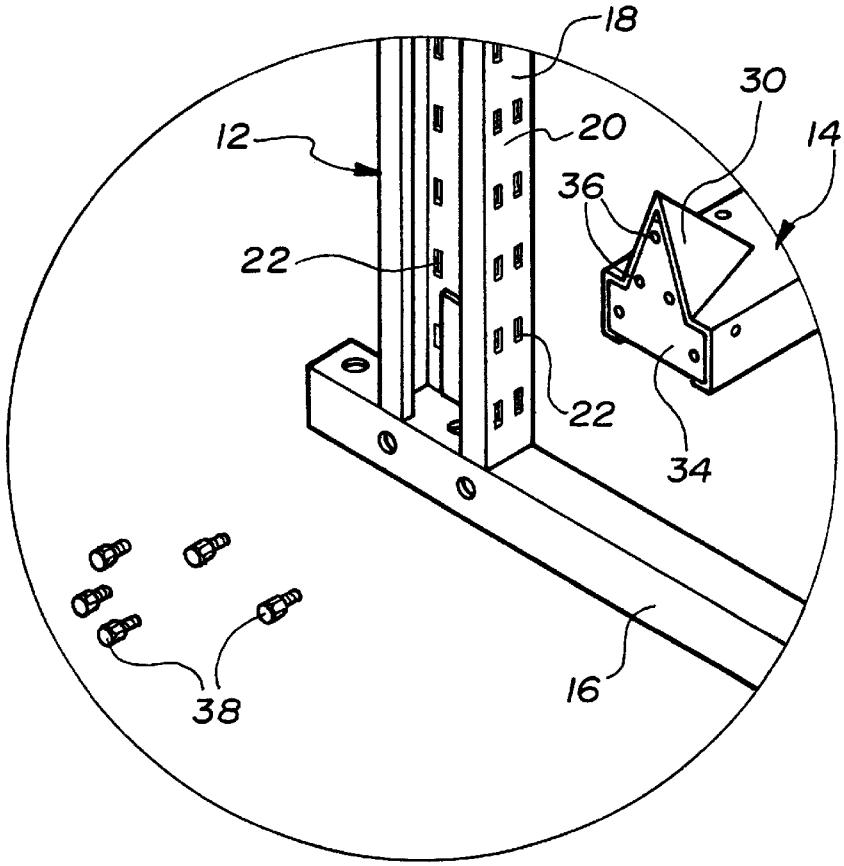
FIG. 4 is an enlarged view of a portion of the frame construction.

Referring first to FIGS. 1 and 2, there is shown a frame construction 10 forming a supporting portion of a modular office furniture system. Generally, the frame 10 is designed to support components of the office system such as desktops, shelves and shelf brackets, and privacy panels. In addition, the frame 10 is designed to facilitate running of wiring for utilities such as telephone, electrical power and computer networks.

The frame 10 generally comprises at least two upright supports 12 and at least two crossbeams 14 interconnected to form a substantially rectangular frame 10. Additional crossbeams 14 and uprights 12 may be added to form larger frame sections. Alternatively, the rectangular frames 10 may be utilized in spaced apart relation to accommodate larger furniture assemblies.

The upright supports 12 have a perpendicular floor engaging foot or leg 16 to broaden the support area for the upright 12 and a vertical upright 18. The upright 18 has a substantially tubular configuration to receive utility wiring and the like. Formed along at least one surface 20 of the upright 18 are a plurality of slots 22 adapted to removably receive components such as shelf brackets and shelf panels.

Figure 7:
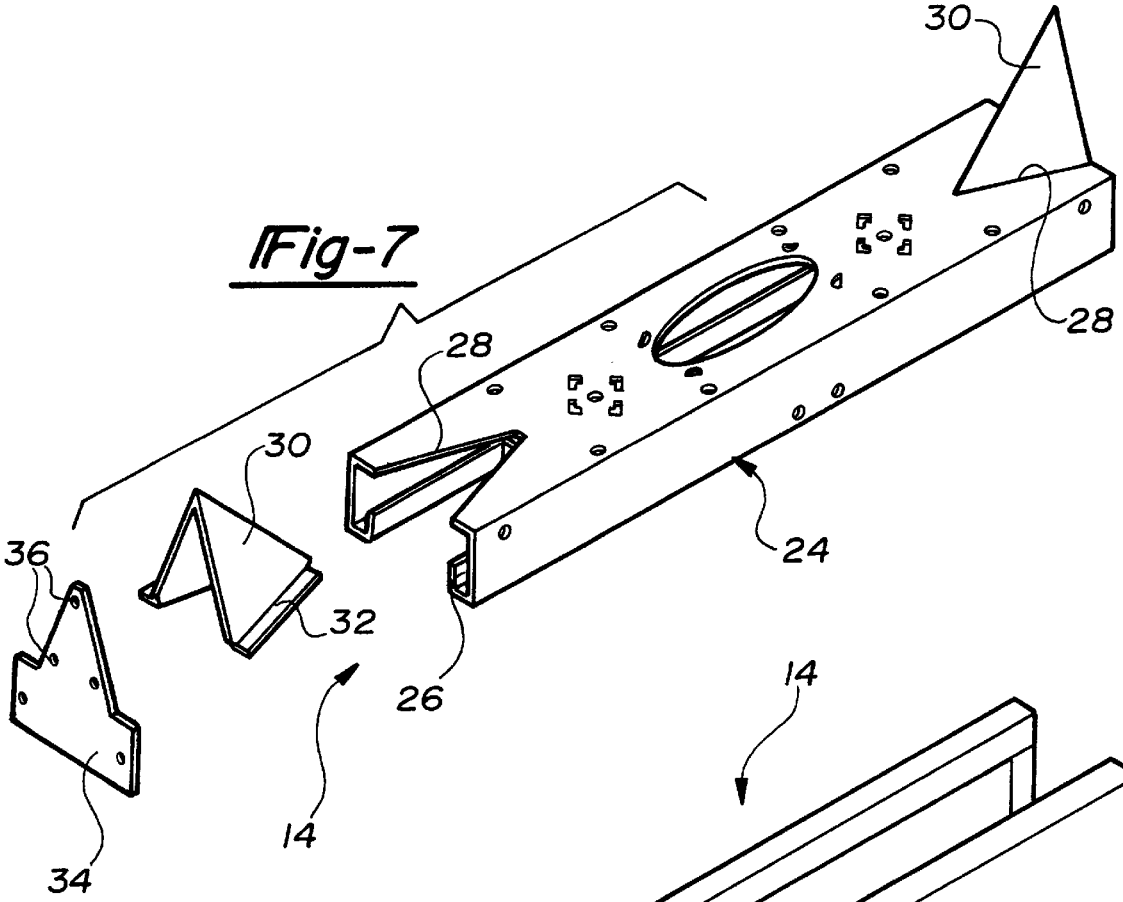
FIG. 7 is an exploded view of a crossbeam of the frame construction.
Figure 8:
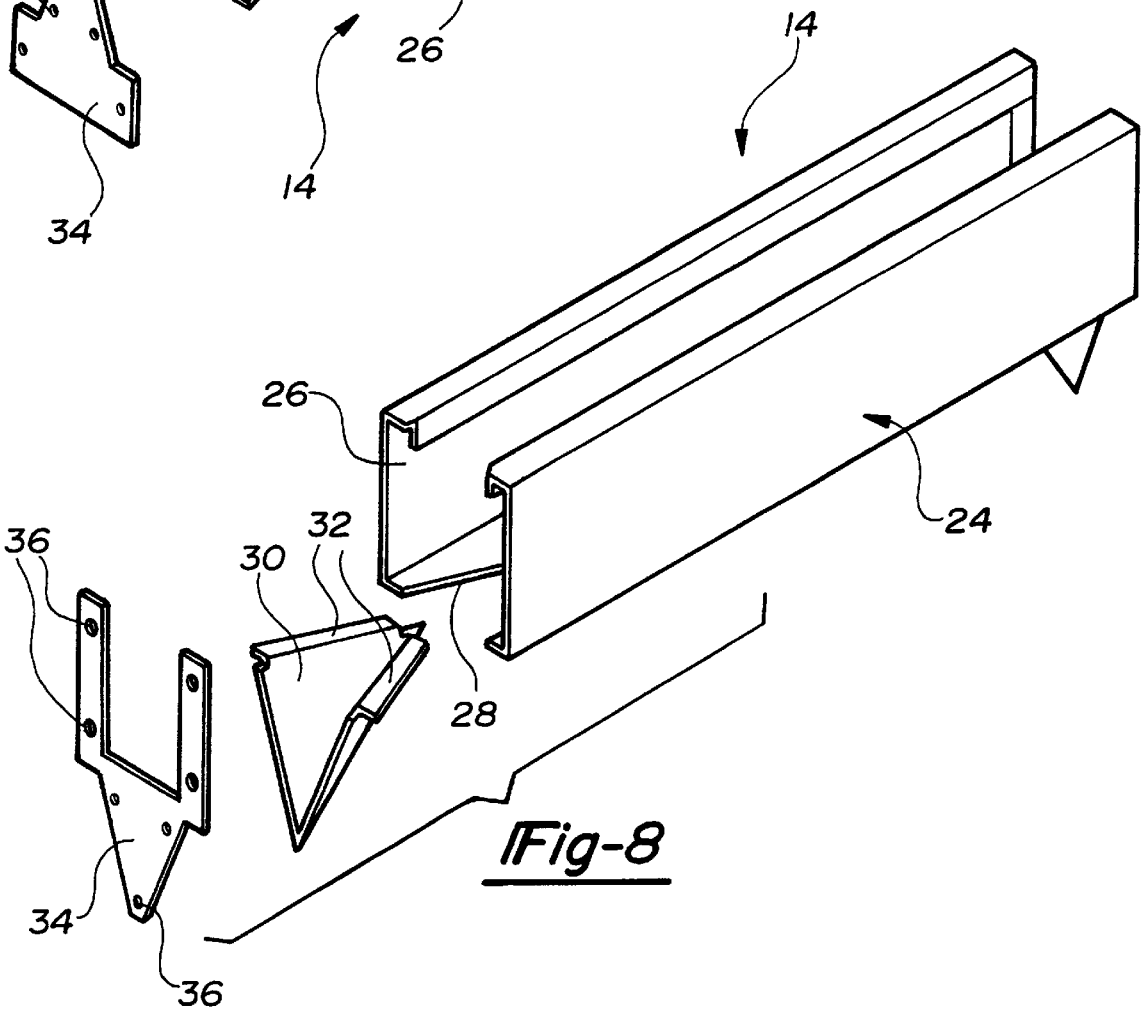
FIG. 8 is an exploded view of an alternative crossbeam of the frame construction.

The crossbeams 14 similarly have a tubular construction to accommodate wiring and are fastened to the uprights 18 to form the frame 10. As best shown in FIGS. 7 and 8, the crossbeams 14 include a tubular body 24 with open ends 26. Formed in direct communication with the open ends 26 are triangular cut-outs 28. The cut-outs 28 receive triangular or pyramidal gussets 30. The gussets 30 include flanges 32 to facilitate securement to the body 24. An end plate 34 configured to fit into the opening formed by the body 24 and gusset 30 is secured to the crossbeam 14. In a preferred embodiment, the gusset 30 and end plate 34 are welded to the body 24. The end plate 34 includes apertures 36 adapted to receive fasteners 38 for securing the crossbeams 14 to the upright supports 12.

Assembly of the frame 10 is accomplished by securing the crossbeams 14 to the uprights 12 using the fasteners 38. The fasteners 38 are inserted through apertures 40 in the uprights 12 to threadably engage the apertures 36 in the end plates 34 of the crossbeams 14. With the ends of the crossbeams 14 drawn against the outer surface 20 of the uprights 18, the triangular gusset 30 engages the upright 12 thereby reducing or eliminating any swaying between the components of the frame 10 thereby improving the stability of the frame construction.

The foregoing detailed description has been given for clearness of understanding only and no unnecessary limitations should be understood therefrom as some modifications will be obvious to those skilled in the art.

What is claimed is:

1. A frame construction for modular furniture, said frame construction comprising:

a pair of uprights maintained in a substantially vertical orientation; and a crossbeam extending between said pair of uprights to interconnect said uprights forming said frame, said crossbeam having an inner passageway and pyramidal gussets proximate each end of said crossbeam, said pyramidal gussets received within a triangular opening in a side wall of said crossbeam, said gussets engaging said corresponding upright upon fastening of said crossbeam between said uprights.

2. The frame construction as defined in claim 1 wherein a pair of crossbeams are mounted between said uprights to form a substantially rectangular frame.

3. The frame construction as defined in claim 1 wherein said crossbeam includes an end plate secured to each end of said crossbeam, said end plate having a triangular portion to enclose said gussets.

4. The frame construction as defined in claim 3 wherein said crossbeam is secured to said uprights by fasteners extending through said uprights into corresponding apertures formed in said end plates of said crossbeam.

5. A frame construction for modular furniture, said frame construction comprising:

a pair of uprights maintained in a substantially vertical orientation; and a pair of crossbeams extending between said uprights to interconnect said uprights forming said frame, said crossbeams having an inner passageway and triangular openings formed in a wall of said crossbeam proximate each end of said crossbeam, said triangular opening matingly receiving a pyramidal gusset to position said pyramidal gusset at said end of said crossbeams, said gussets engaging said corresponding upright upon fastening of said crossbeams between said uprights to support said frame construction.

6. The frame construction as defined in claim 5 wherein said crossbeams include end plates secured to each end of said crossbeams for enclosing said crossbeams, said end plate having a triangular portion to enclose said gussets.

7. The frame construction as defined in claim 6 wherein said crossbeams are secured to said uprights by fasteners extending through said uprights into corresponding apertures of said end plates to engage said gussets with said uprights.

* * * * *